US006198034B1

(12) United States Patent
Beach et al.

(10) Patent No.: US 6,198,034 B1
(45) Date of Patent: Mar. 6, 2001

(54) ELECTRONIC TONE GENERATION SYSTEM AND METHOD

(75) Inventors: Ronald O. Beach, 1606 Boulder Ct., Rochester, MI (US) 48306; John E. Nemazi, Bloomfield Hills, MI (US)

(73) Assignee: Ronald O. Beach, Rochester, MI (US)

( * ) Notice: Subject to any disclaimer, the term of this patent is extended or adjusted under 35 U.S.C. 154(b) by 0 days.

(21) Appl. No.: 09/456,798

(22) Filed: Dec. 8, 1999

(51) Int. Cl.[7] ..... G10H 1/057; G10H 1/08; G10D 13/00; G10F 1/08

(52) U.S. Cl. ..... 84/600; 84/698; 84/703; 84/407; 84/DIG. 12

(58) Field of Search ..... 84/600–602, 645, 84/267, 742, 402–407, 738, 702, 703, DIG. 12, 625, 660, 698

(56) References Cited

U.S. PATENT DOCUMENTS

| | | | | |
|---|---|---|---|---|
| 3,085,460 | * | 4/1963 | Edwards | 84/267 X |
| 3,578,894 | | 5/1971 | Schwartz et al. . | |
| 3,622,681 | | 11/1971 | Hopping et al. . | |
| 3,941,082 | | 3/1976 | Malta . | |
| 4,159,491 | | 6/1979 | Beach . | |
| 4,805,511 | | 2/1989 | Schwartz . | |
| 4,980,519 | | 12/1990 | Matthews . | |
| 5,296,641 | * | 3/1994 | Stelzel | 84/602 |
| 5,471,006 | | 11/1995 | Schwartz et al. . | |
| 5,648,627 | | 7/1997 | Usa . | |
| 5,700,966 | * | 12/1997 | LaMarra | 84/645 |
| 6,025,553 | * | 2/2000 | Lee | 84/602 X |

OTHER PUBLICATIONS

Schulmerich World Leader in Bells, Carillons & Towers, 1995 Schulmerich Carillons, Inc., Sep. 1998.
Strikingly Different: The Schulmerich Collection, 1996, Schulmerich Carillons, Inc., Feb. 1998.
Schulmerich Handbells, MelodyChime™ Instruments, & Accessories, Jun. 1998.

* cited by examiner

*Primary Examiner*—Stanley J. Witkowski
(74) *Attorney, Agent, or Firm*—Brooks & Kushman P.C.

(57) ABSTRACT

An electronic tone generation system comprises a plurality of portable handheld wireless transmitters, with each transmitter representing at least one music note and being operative to transmit a signal indicative of that at least one note. A receiver receives the signals from the transmitters, and control logic connected to the receiver is operative to determine the at least one note corresponding to a received signal and to determine at least one tone assigned to that at least one note. A tone generator produces tones in accordance with the determinations of the control logic.

23 Claims, 3 Drawing Sheets

ELECTRONIC TONE GENERATION SYSTEM AND METHOD

TECHNICAL FIELD

The present invention relates to an electronic tone generation system and method.

BACKGROUND ART

An existing electronic tone generation system includes a keyboard connected to a scanning device. The scanning device detects when the different keys or combinations of keys are depressed at the keyboard. The scanning device sends information representing currently depressed keys on the keyboard to a microprocessor. The microprocessor accesses data stored within a memory and processes the information from the scanning device along with the data from memory, and sends output signals to a tone generator. The tone generator, in turn, generates tones in accordance with control signals received from the microprocessor.

One existing electronic tone generating system is described in U.S. Pat. No. 4,805,511. In that system, the microprocessor uses information stored in the memory to produce tone generator outputs that model the strike of a bell.

Although existing tone generating systems have been used in many applications that have been commercially successful, the systems are generally designed for use by a single player at a keyboard type input device. An electronic tone generating system is often a less costly alternative to traditional instruments, such as a pipe organ or the various instruments found in an orchestra. When there are many players, such electronic tone generating systems are of limited use.

For the foregoing reasons, there is a need for an electronic tone generating system that may be used in situations where there are many players.

DISCLOSURE OF INVENTION

It is, therefore, an object of the present invention to provide an electronic tone generation system and method in which multiple wireless transmitters communicate with a receiver connected to control logic that operates a tone generator.

In carrying out the above object, an electronic tone generation system is provided. The system comprises a plurality of portable handheld wireless transmitters. Each transmitter represents at least one music note and is operative to transmit a signal indicative of that at least one note. The system further comprises a receiver, control logic, and a tone generator. The receiver is configured to receive the signals from the transmitters. The control logic is connected to the receiver, and operates to determine the at least one note corresponding to a received signal. Further, the control logic operates to determine at least one tone assigned to that at least one note. In turn, the tone generator operates to produce tones in accordance with the determinations of the control logic.

Advantageously, a single tone generator and associated control logic may be used to generate music in accordance with signals received from a plurality of portable handheld wireless transmitters. Players may each be provided with an individual handheld transmitter that operates to turn on a tone generator.

In one embodiment, the at least one assigned tone determined by the control logic includes a fundamental tone and any associated overtones to simulate a handbell. The wireless transmitter may be battery powered, and may be configured with a switch that is selectively operative to cause the wireless transmitter to transmit. The switch may take a number of different forms such as, for example, a push button switch or an inertia switch. The inertia switch could be configured to cause the transmitter to transmit upon rapid movement of the transmitter by the player, for example, to simulate a handbell. Alternatively, a wireless transmitter may be configured for line of sight communication with the receiver such that the receiver operates to receive a signal from the transmitter when the transmitter falls within the line of site of the receiver.

The wireless transmitter may be configured to transmit a signal that represents the at least one note in a variety of different ways. For example, the represented note or notes may be indicated by a modulated pulse code or by the frequency of the transmitted signal. Further, the wireless transmitter may be configured to transmit at different frequency ranges in different embodiments of the present invention. For example, the wireless transmitters may be configured to transmit at radio frequencies or in the alternative, may be configured to transmit at infrared frequencies, depending on the intended environment for the system.

In a preferred construction, the system further comprises a set of stop keys accessible to a director. Each stop key is associated with a group of related notes. The control logic is configured to direct the tone generator to produce tones associated with unasserted stop keys. Assertion of a stop key limits tone production, and in some implementations, determines what instruments are to be played. The control board may be handwired to the system control logic, or may have a wireless link.

Further, in carrying out the present invention, another embodiment for an electronic tone generation system is provided. The system comprises a portable handheld wireless transmitter, a receiver, control logic, and a tone generator. The control logic operates to determine a note along with an additional parameter indicated by a received signal. The tone generator operates to produce a tone in accordance with the note and the parameter.

In this embodiment, the parameter may represent any of a number of different characteristics for the sound to be produced in response to the transmitter signal. In one implementation, the parameter represents a sound level for the note such that the tone generator produces the tone in accordance with the note and at the sound level. Alternatively, the parameter represents a decay rate adjustment for the note such that the tone generator produces the tone in accordance with the note and the decay rate adjustment. That is, the parameter may modify the normal decay rate associated with the note. Of course, multiple parameters may be sent in the transmitter signal. For example, the transmitter signal may contain sufficient information to indicate the note to be played, a sound level for the note (for example, an amplitude gain factor), a decay rate adjustment factor, in addition to any other pieces of information. The sound level parameter may be determined by, for example, an acceleration of the transmitter to simulate the striking of a bell. The decay rate adjustment factor may be indicated with, for example, position of a slide switch on the transmitter. It is appreciated that the amount of information that may be included in the transmitter signal in addition to the music note may be quite extensive.

Further, in one implementation, the transmitter is configured to allow selection of an instrument (possibly with a selector switch on the transmitter). The parameter represents the selected instrument for the note such that the tone generator produces the tone in accordance with the note and the selected instrument. Still further, the transmitter may operate to produce additional signals as directed by the player. For example, the transmitter may be selectively operative to produce a quench signal indicative of the note. Upon the receiver receiving the quench signal, the control logic directs the tone generator to quench a tone produced in accordance with the note to simulate, for example, the rapid damping of a handbell that occurs when the ringing bell is grasped by the player.

Further, in carrying out the present invention, an electronic tone generation method is provided. The method comprises transmitting a signal with a wireless transmitter, the signal being indicative of at least one music note, and receiving the signal at a receiver. The method further comprises determining the at least one note corresponding to the received signal, determining at least one tone assigned to that at least one note, and generating the at least one assigned tone.

The advantages associated with embodiments of the present invention are numerous. For example, embodiments of the present invention reduce the cost associated with providing instruments to a number of players to form, for example, a handbell choir. That is, in accordance with the present invention, portable handheld wireless transmitters communicate with the receiver, control logic, and associated tone generator to allow numerous players to utilize a single tone generator and associated electronics. The present invention has many applications. For example, a student/teacher environment may advantageously employ embodiments of the present invention to avoid the expensive alternative of providing a traditional set of handbells for a group of players. Further, it is appreciated that a transmitter may correspond to a single note, a group of notes such as a chord, or even a series of notes, as desired, in accordance with the present invention. Even further, the invention is not limited to any particular instrument, or to a single instrument as multiple instrument embodiments may employ, for example, a stop key arrangement.

The above object and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
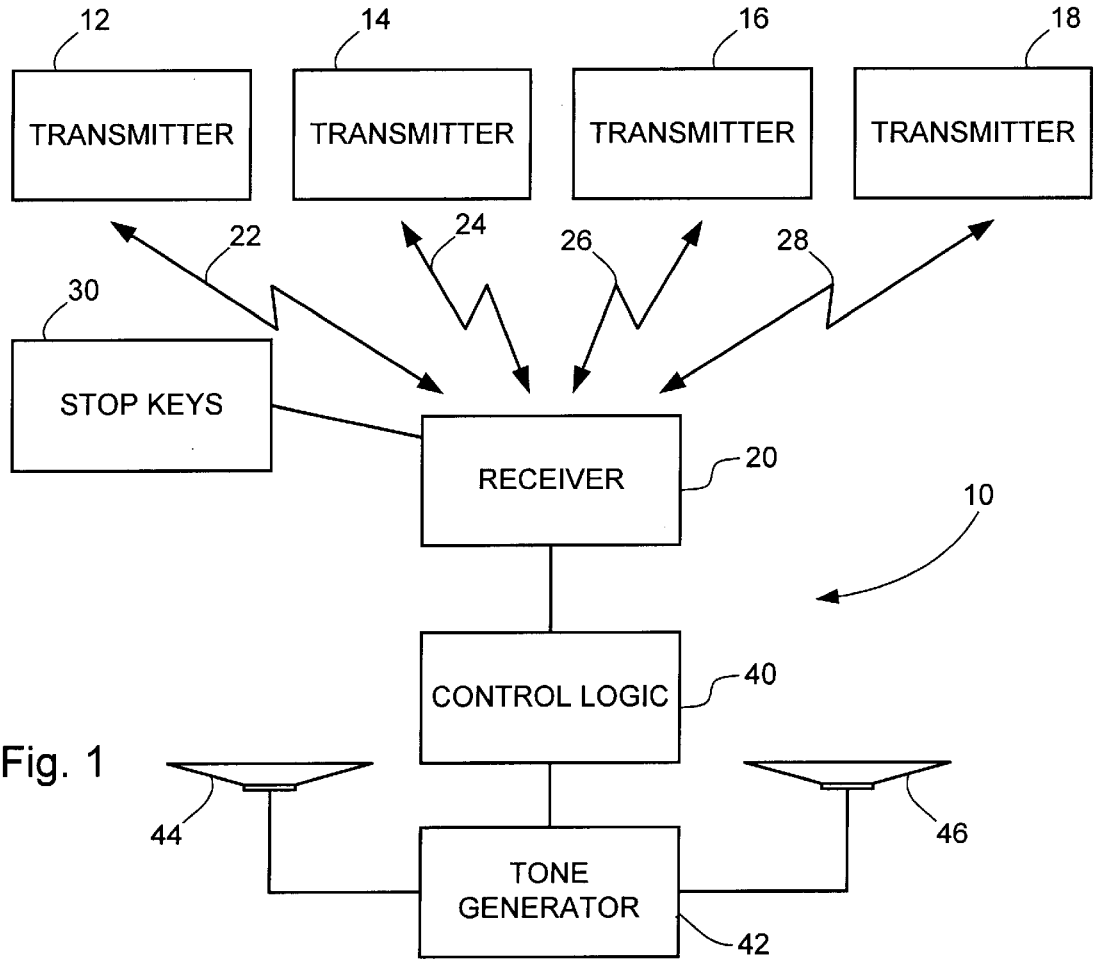
FIG. 1 is block diagram illustrating a system of the present invention, utilizing wireless transmissions of multiple transmitters to cause production of tones at the tone generator.

With reference to FIG. 1, a system of the present invention is generally indicated at 10. System 10 includes a plurality of portable handheld wireless transmitters 12, 14, 16, 18. A receiver 20 is configured to receive the signals from the transmitters. There are a number of different ways to format the wireless transmissions between transmitters 12, 14, 16, 18 and receiver 20. For example, the transmissions may occur at radio frequencies or infrared frequencies. Further, each wireless transmitter may be configured to transmit a signal that represents a note (or notes) with a modulated pulse code. As such, each transmitter would transmit a different pulse code so that the receiver could distinguish between different transmitters. Further, each handheld device may be a transceiver and utilize listen before talk techniques to avoid interference from other transceivers. For example, the transceiver may listen and then transmit if no other transceiver is transmitting at that time, or wait a random amount of time and then listen again. Further, for example, a polling transmitter may work with receiver 20, with the polling transmitter polling the handheld devices to request transmissions so that no two handheld devices transmit at the same time. That is, each handheld device would not transmit until polled by the polling transmitter.

Alternatively, each transmitter may transmit a different frequency so that the receiver may distinguish based on frequency. Of course, it is appreciated by those skilled in wireless communication that there are many different techniques available for carrying identifying information from the transmitters to the receiver. Further, although in a basic implementation, each transmitter has a fixed code or signal that it transmits, the transmitters could be configured with switches, jumpers, or programmable memory so that the transmitter may be programmed to transmit a particular signal. Further, the receiver and control logic may be, in a basic implementation, designed to have a static table for determining the represented note based on the transmission received from the transmitter. In the alternative, the system may be configurable to allow assignment of each handheld device to a particular musical note or notes. Of course, the examples given above are only a few examples for implementation of the wireless communication, and it is appreciated that embodiments of the present invention are independent of any particular communication scheme and associated implementation thereof, including configurable transmitters, configurable receivers, configurable transceivers, and even configurable control logic to allow many control and communication arrangements. And, as mentioned previously, it is appreciated that the information in the transmitted signal may include more information than a simple indication of the note to be played. For example, the signal may represent additional parameters such as sound level, decay rate, and any other information contemplated.

With continuing reference to FIG. 1, the wireless communications between transmitters 12, 14, 16, 18 and receiver 20 are shown at arrows 22, 24, 26, 28, respectively. In a preferred embodiment, a set of stop keys 30 is accessible to a director at a control board. Each stop key is associated with a group of related tones. The control logic is configured to direct the tone generator to produce tones associated with unasserted stop keys to allow assertion of a stop key to limit tone production.

Advantageously, the stop key arrangement permits the musical director to get more variety out of the transmitters. For example, the director may control, with the stop keys, what instruments are played by the players. Embodiments of the present invention are not limited to any one musical instrument. It is appreciated that embodiments of the present invention could provide a musician with many possibilities for writing, or arranging music, in addition to many possibilities for modifying existing music, by adding more instruments. In a suitable implementation, the stop keys or stop switches that the director would use are configured to change the instruments being played by the players similar to the way that stops change the tone colors for an organ.

Receiver 20 receives signals from transmitters 12, 14, 16, 18, and is connected to control logic 40. The signal from a transmitter represents at least one musical note in addition to other parameters, as desired. For example, a particular transmitter may represent a single note of some instrument, while a different transmitter may represent a chord. Control logic 40 operates to determine the note or notes corresponding to a received signal. Of course, as mentioned previously, the note or notes assigned to a particular transmitter may be represented in a number of different ways. In addition to determining the note or notes corresponding to a signal received at the receiver, the control logic determines a tone or group of tones assigned to that note or group of notes . The control logic, in turn, generates a signal indicative of the assigned tone and passes that signal to tone generator 42. Tone generator 42 operates to produce a tone in accordance with the control logic signal, at stereo speakers 44 and 46. Of course, tone generator 42, although being shown with stereo output, may be configured with any known output channel arrangement such as, for example, mono, stereo, or even configured with output of more than two channels. Tone generator 42 may be conveniently located at the underside of a handbell table, when the transmitters represent handbells.

Figure 2:
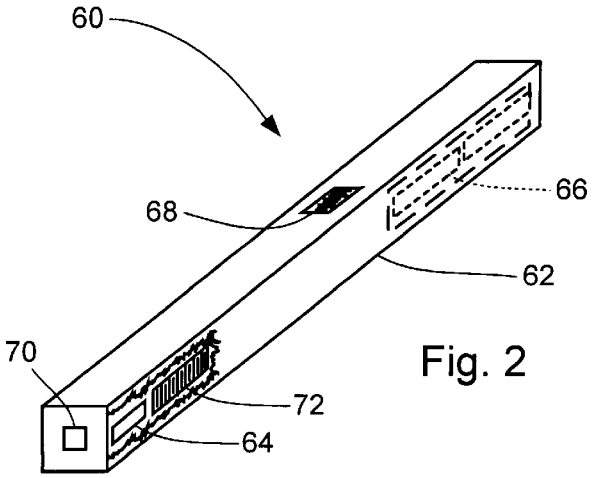
FIG. 2 is an exemplary construction of a portable handheld wireless transmitter for use in a system of the present invention, with the transmitter having a baton form.

With reference to FIG. 2, a baton implementation of a transmitter is generally indicated at 60. Of course, the portable handheld wireless transmitters are not limited to any particular physical implementation, and the baton and bell shapes described herein are exemplary. Baton 60 includes a main body 62, and houses a transmitter device 64. In one configuration, transmitter 60 is powered by a battery source 66. As shown, a push button switch 68 selectively operates transmitting device 64. In one implementation, the switch may be an on/off switch, with transmission taking place in response to rapid movement of the baton (as detected by, for example, a separate inertia switch). Of course, other switch arrangements may be employed to simulate the forward thrust of a handbell. For some applications, a mercury switch may be appropriate.

As mentioned previously, the particular signal that is transmitted by transmitter device 64 may be predetermined when handheld transmitter 60 is assembled, or may configured, for example, with jumpers 72 (or in the alternative, switches, or even with a programmable memory). Further, because the transmitter may use a number of different frequencies, some embodiments may employ an aperture 70 to provide line of sight with the receiver (for example, infrared spectrum communications), while other embodiments such as some radio frequency implementations may not require line of sight.

Figure 3:
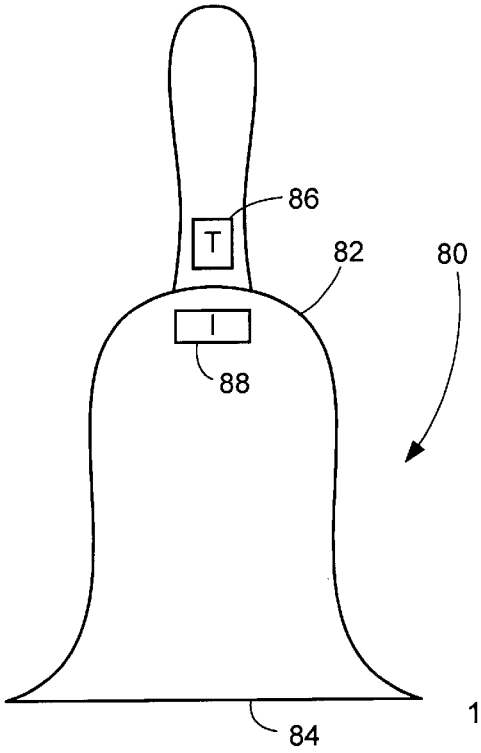
FIG. 3 is another exemplary construction for a wireless transmitter for use with the system of the present invention with this wireless transmitter having a bell type shape.

With reference to FIG. 3, a bell shaped transmitter device is generally indicated at 80. The bell shaped transmitter may suitably be formed with a body 82 of injection molded plastic. End 84 may be closed or open depending on if line of sight communication is required for the particular communication link implemented. Further, transmitter device 86 may be implemented in a number of different ways as described above. Although a push button switch may be suitable for activating transmitter device 86, an inertia switch 88 may be provided in the alternative. The inertia switch 88 would cause the transmitter to transmit when the bell is moved rapidly, as would be required to ring a mechanical bell. Further, the transmitted signal may also include a sound level parameter that is related to the peak acceleration of the handheld device as a simulated bell is rung. The transmitter may be selectively operative to produce a quench signal indicative of the note. Upon the receiver receiving the quench signal, the control logic directs the tone generator to quench a tone produced in accordance with the note to stimulate, for example, the rapid damping of a handbell that occurs when the ringing bell is grasped by the player.

Figure 4:
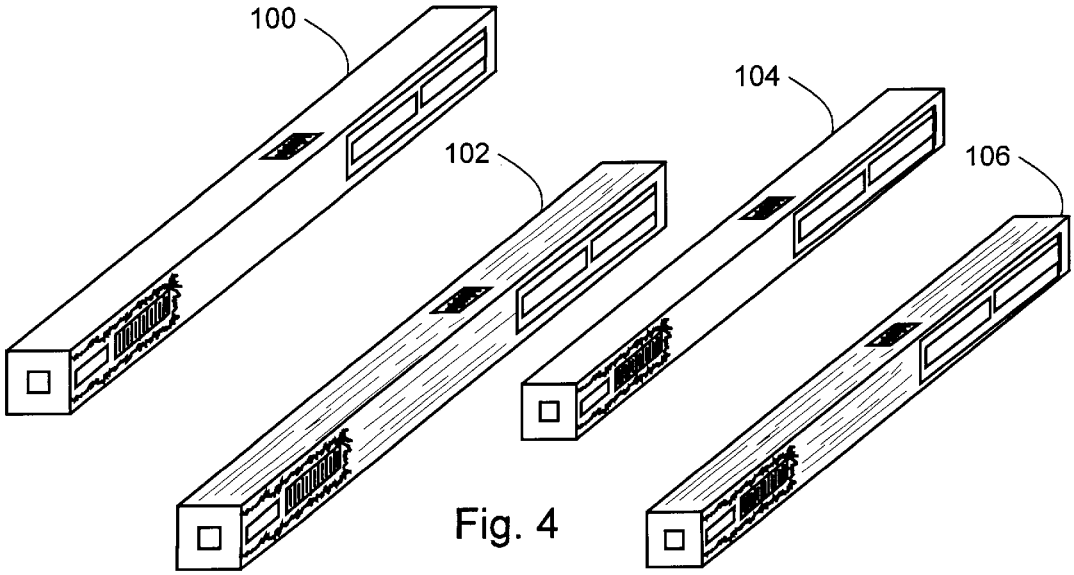
FIG. 4 illustrates the use of differently sized batons that represent different octaves, and the use of different shades or colors to distinguish the sharp and flat notes.

With reference to FIG. 4, separate baton type transmitters are illustrated. Of course, although FIG. 4 shows a plurality of baton type transmitters that have different physical characteristics that represent the different octaves and note types, similar physical distinguishing characteristics may be provided on bell type transmitters such as transmitter 80 of FIG. 3. With continuing reference to FIG. 4, transmitters 100 and 102 are larger than transmitters 104 and 106. In one implementation, the larger transmitters are a lower octave than the smaller transmitters. For example, a note range that extends over six octaves may include a plurality of transmitters in which the transmitters have six different sizes or, transmitter size may continuously vary over the entire note range using larger batons or bells for lower frequencies and smaller batons or bells for higher frequencies. Further, batons 102 and 106 are shown having a darker color than batons 100 and 104. Some implementations of the present invention may use darker colored batons (or bells) and lighter colored batons (or bells) to mimic the black and white keys of a piano.

Further, it is to be appreciated that each transmitter is not limited to a single note. If desired, some of the transmitting devices may represent chords. Still further, although a baton or bell has been referred to as having a corresponding note, it is appreciated that this note may include a fundamental tone in addition to one or more overtones to simulate an instrument (such as a handbell). For example, mechanical bells generally produce a musical note that includes a fundamental tone in addition to several different overtones, with each tone having a particular starting amplitude and associated decay rate.

Figure 5:
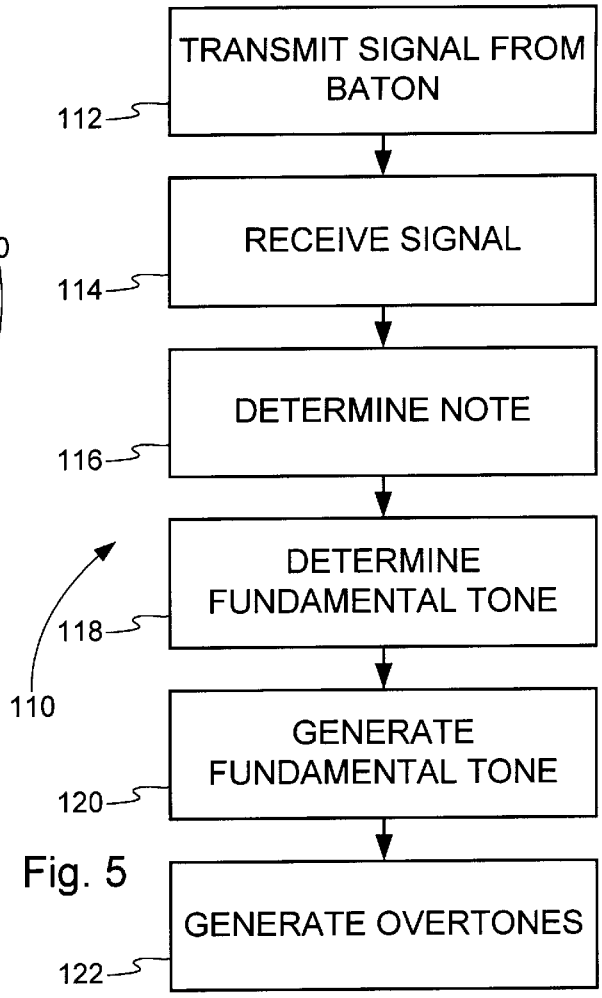
FIG. 5 is a block diagram illustrating a method of the present invention for generating tones with a system utilizing a plurality of portable handheld wireless transmitters.

With reference to FIG. 5, an electronic tone generation method of the present invention is generally indicated at 110. At block 112, a signal is transmitted from a wireless transmitter, such as a baton or bell type transmitter or any other transmitter having a different shape, and the signal indicates a music note (or notes) and optionally indicates at least one additional parameter such as sound level. At block 114, the signal is received at the receiver. At block 116, the note (or notes) corresponding to the received signal is determined by control logic 40 (FIG. 1). At block 118, the fundamental tone assigned to a note is determined. At blocks 120 and 122, the fundamental tone and any associated overtones (in a handbell simulation) for the music note are generated by the tone generator 42 (FIG. 1).

It is to be appreciated that embodiments of the present invention may be employed to simulate many different mechanical instruments. In particular, embodiments of the present invention are well suited for percussion type instruments when a sound level parameter is included within the transmitter signal. And more particularly, embodiments of the present invention are well suited for implementation of a handbell set. In accordance with the present invention, by applying electronic tone generation to a handbell type instrument, expense of the handbell set is reduced.

Further, it is to be appreciated that stop keys on a control board give a music director great control over the group of players. The control board could be hardwired to the rest of the receiver side components, or may have its own wireless link (to the same or to an additional dedicated receiver). The director would not only direct the players but also select the type of bell, chime, organ, piano, or other tone type. The director would truly control the music by directing players, selecting instruments and tones, changing tempos, etc., in a system utilizing wireless links. The wireless links have many potential implementations, such as radio frequency links, or infrared links, to name a few. And, the transmitters may take many shapes, such as batons, bell shaped devices, or even pistol grip devices, to name just a few. Further, it is appreciated that in some embodiments, the sounds generated at the tone generator may be prerecorded sounds of actual physical instruments.

Figure 6:
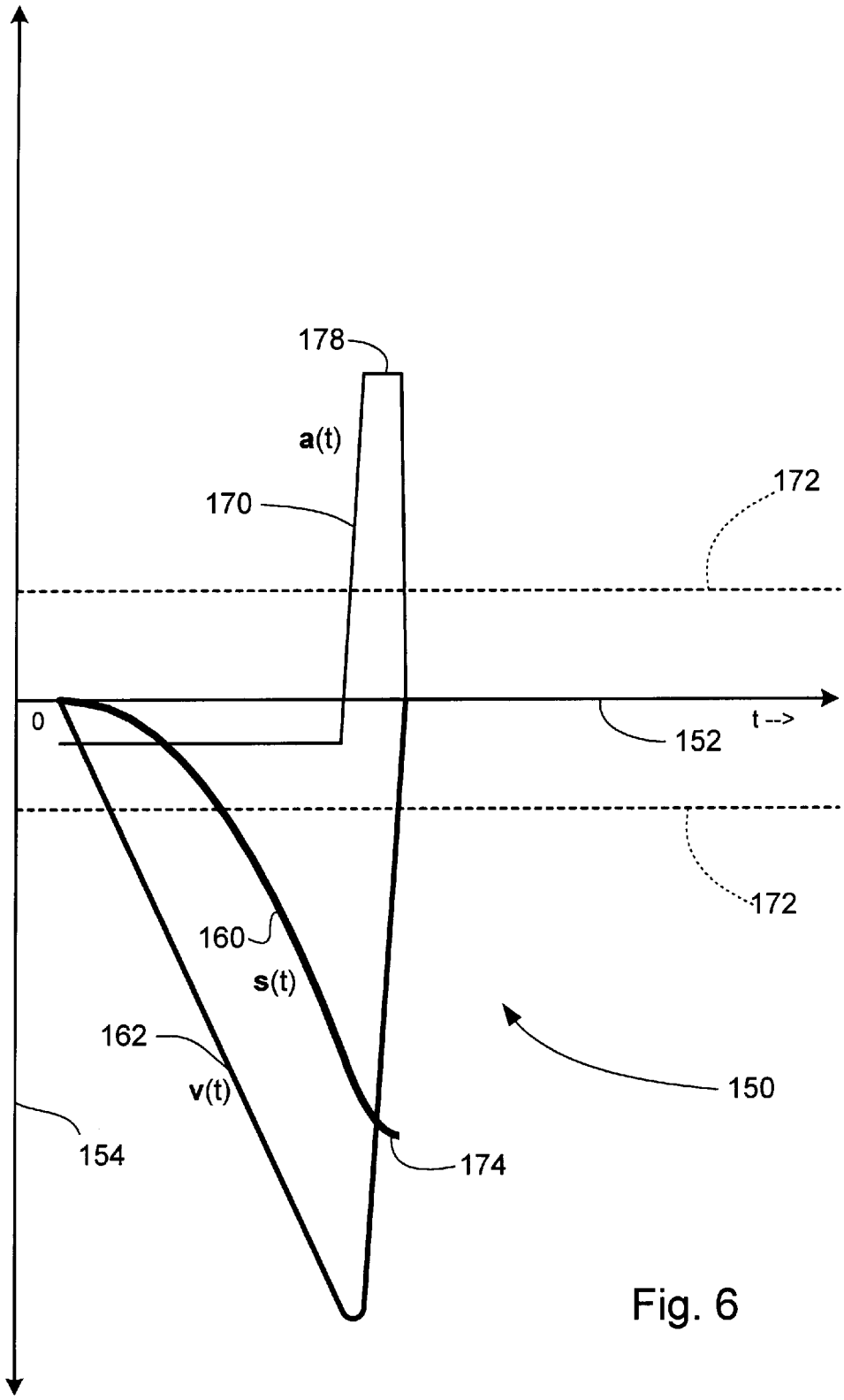
FIG. 6 is a graph depicting position, velocity, and acceleration of a handheld transmitter to illustrate the use of a sound level or peak acceleration parameter.

With reference to FIG. 6, a graph depicts the position, velocity, and acceleration of a handheld transmitter in an implementation that simulates the physical movement of a mechanical handbell to cause the transmitter to transmit. Plots of the three functions are generally indicated at 150. Time is indicated by the abscissa measured parallel to axis 152, while position and the derivatives thereof are indicated by the ordinate measured parallel to axis 154. Plot 160 illustrates the position, s(t), of the transmitter. In this implementation, a quick, rapid movement of the handheld transmitter (simulating the ringing of a bell) causes the transmitter to transmit its signal. The signal may advantageously include additional information such as a sound level based on the acceleration of the device, as well as other information such as a decay rate adjustment or instrument selection. In accordance with the present invention, any number of additional switches may be provided on the handheld device so that additional information may be incorporated in the transmitted signal.

With continuing reference to FIG. 6, velocity, v(t), is indicated at plot 162, while acceleration, a(t), is indicated at plot 170. When acceleration exceeds acceleration threshold 172, the transmitter sends a signal to the receiver to cause the appropriate tones to be generated. The threshold is used to avoid accidental transmissions. If desired, a trim mechanism may be provided to adjust the threshold. A careful examination of graph 150 indicates that portion 178 of acceleration curve 170 exceeds threshold 172, and corresponds to portion 174 of the position plot 160. In preferred embodiments, a magnitude of acceleration plot portion 178 may be provided as a parameter that is indicated by the signals sent from the transmitter to produce more accurate sounds at the tone generator.

That is, a sharp acceleration may produce a louder sound than a somewhat milder acceleration. Further, additional parameters may be included as information within the transmitted signal. For example, a decay rate adjustment factor and an instrument selection are just a few examples. Of course, as mentioned above, the particular communications to be employed are not limited to any particular communication technique. As such, although some implementations of the present invention may transmit as the acceleration exceeds the threshold, other embodiments may achieve the same result using a polling technique. That is, the receiver rapidly polls all of the transmitters such that as soon as the acceleration exceeds the threshold, the transmitter transmits upon the next polling signal or query sent to it. Further, and as mentioned previously, embodiments of the present invention are not limited to any particular modulation scheme or coding technique.

While the best mode for carrying out the invention has been described in detail, those familiar with the art to which this invention relates will recognize various alternative designs and embodiments for practicing the invention as defined by the following claims.

What is claimed is:

1. An electronic tone generation system for electronically simulating a plurality of mechanical handbells. the system comprising:

a plurality of individual portable handheld wireless transmitters, each transmitter representing a corresponding mechanical handbell for playing at least one music note and being operative to transmit a signal indicative of that at least one note;

a receiver configured to receive the signals from the transmitters;

control logic connected to the receiver, the control logic being operative to determine the at least one note corresponding to a received signal and to determine at least one simulated mechanical handbell tone assigned to that at least one note; and a tone generator operative to produce simulated mechanical handbell tones in accordance with the determinations of the control logic.

2. The system of claim 1 wherein the at least one assigned tone determined by the control logic includes a fundamental tone and any associated overtones to simulate a handbell.

3. The system of claim 1 wherein each wireless transmitter is battery powered.

4. The system of claim 1 wherein each wireless transmitter further comprises:

a switch selectively operative to cause the wireless transmitter to transmit.

5. The system of claim 4 wherein the switch is a push button switch.

6. The system of claim 4 wherein the switch is an inertia switch configured to cause the transmitter to transmit upon rapid movement of the transmitter by a player.

7. The system of claim 1 wherein each wireless transmitter is configured for line of sight communication with the receiver such that the receiver operates to receive a signal from a transmitter when that transmitter falls within line of sight of the receiver.

8. The system of 1 wherein each wireless transmitter is configured to transmit a signal wherein the represented at least one note is indicated by a modulated pulse code.

9. The system of 1 wherein each wireless transmitter is configured to transmit a signal wherein the represented at least one note is indicated by a frequency of the signal.

10. The system of claim 1 wherein each wireless transmitter is configured to transmit at a radio frequency.

11. The system of claim 1 wherein each wireless transmitter is configured to transmit at an infrared frequency.

12. The system of 1 further comprising:

a set of stop keys accessible to a director, each stop key being associated with a group of related tones, wherein the control logic is configured to direct the tone generator to produce tones associated with unasserted stop keys to allow assertion of a stop key to limit tone production.

13. An electronic tone generation system for electronically simulating a plurality of percussion instruments, the system comprising:

a plurality of individual portable handheld wireless transmitters; each transmitter representing a corresponding percussion instrument for playing a music note and being operative to transmit a signal indicative of the note and of a parameter for the note;

a receiver configured to receive the signals from the transmitters;

control logic connected to the receiver, the control logic being operative to determine the note and the parameter corresponding to a received signal; and a tone generator operative to produce simulated percussion instrument tones in accordance with the note and the parameter.

14. The system of claim 13 wherein the parameter represents a sound level for the note such that the tone generator produces the tone in accordance with the note and the sound level.

15. The system of claim 13 wherein the transmitter is selectively operative to produce a quench signal indicative of the note, wherein upon the receiver receiving the quench signal, the control logic directs the tone generator to quench a tone produced in accordance with the note.

16. The system of claim 13 wherein the parameter represents a decay rate adjustment for the note such that the tone generator produces the tone in accordance with the note and the decay rate adjustment.

17. An electronic tone generation system comprising:

portable handheld wireless transmitter representing a music note and being operative to transmit a signal indicative of the note and of a parameter for the note;

a receiver configured to receive the signal from the transmitter;

control logic connected to the receiver, the control logic being operative to determine the note and the parameter corresponding to the signal; and a tone generator operative to produce a tone in accordance with the note and the parameter, and wherein the transmitter is configured to allow selection of an instrument, and wherein the parameter represents the selected instrument for the note such that the tone generator produces the tone in accordance with the note and the selected instrument.

18. An electronic tone generation system comprising:

a portable handheld wireless transmitter representing a music note and being operative to transmit a signal indicative of the note and of a parameter for the note;

a receiver configured to receive the signal from the transmitter;

control logic connected to the receiver the control logic being operative to determine the note and the parameter corresponding to the signal; and a tone generator operative to produce a tone in accordance with the note and the parameter, and wherein the transmitter is configured to transmit when acceleration of the transmitter, caused by rapid movement of the transmitter by a player, exceeds a predetermined threshold.

19. The system of claim 18 wherein the parameter represents a magnitude of the acceleration such that the tone generator produces the tone in accordance with the note and transmitter acceleration magnitude.

20. The system of claim 18 wherein the transmitter is selectively operative to produce a quench signal indicative of the note, wherein upon the receiver receiving the quench signal, the control logic directs the tone generator to quench a tone produced in accordance with the note.

21. The system of claim 18 wherein the parameter represents a decay rate adjustment for the note such that the tone generator produces the tone in accordance with the note and the decay rate adjustment.

22. The system of claim 18 wherein the transmitter is configured to allow selection of an instrument, and wherein the parameter represents the selected instrument for the note such that the tone generator produces the tone in accordance with the note and the selected instrument.

23. An electronic tone generation method for electronically simulating a plurality of mechanical handbells, the method comprising:

transmitting a signal with a wireless transmitter, the signal being indicative of a corresponding mechanical handbell for playing at least one music note;

receiving the signal at a receiver;

determining the at least one note corresponding to the received signal;

determining at least one simulated mechanical handbell tone assigned to the at least one note; and generating the at least one assigned tone.

* * * * *